US007454879B2

(12) United States Patent
Boldrini et al.

(10) Patent No.: US 7,454,879 B2
(45) Date of Patent: Nov. 25, 2008

(54) DEVICE FOR FOLDING THE LIDS OF RIGID PACKETS IN MACHINES FOR MAKING SUCH PACKETS, AND A MACHINE INCORPORATING SUCH A DEVICE

(75) Inventors: Fulvio Boldrini, Ferrara (IT); Daniele Coi, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 0 days.

(21) Appl. No.: 11/659,276

(22) PCT Filed: Jul. 29, 2005

(86) PCT No.: PCT/IB2005/002605

§ 371 (c)(1),
(2), (4) Date: Feb. 2, 2007

(87) PCT Pub. No.: WO2006/016270

PCT Pub. Date: Feb. 16, 2006

(65) Prior Publication Data

US 2007/0240384 A1 Oct. 18, 2007

(30) Foreign Application Priority Data

Aug. 3, 2004 (IT) ..... BO2004A0498

(51) Int. Cl.

| | |
|---|---|
| ***B65B 7/20*** | (2006.01) |
| ***B65B 7/26*** | (2006.01) |
| ***B65B 43/08*** | (2006.01) |
| ***B31B 1/28*** | (2006.01) |

(52) U.S. Cl. ..... 53/378.3; 53/456; 53/376.3; 493/164

(58) Field of Classification Search ..... 53/267, 53/284.5, 376.3, 378.3, 377.2, 377.5, 456, 53/482; 493/163, 164, 166
See application file for complete search history.

(56) References Cited

U.S. PATENT DOCUMENTS

| | | | | |
|---|---|---|---|---|
| 2,651,898 | A * | 9/1953 | Kimball | 53/48.1 |
| 2,849,846 | A * | 9/1958 | McGihon | 53/370.6 |
| 4,612,752 | A * | 9/1986 | Deal | 53/377.3 |

(Continued)

FOREIGN PATENT DOCUMENTS

| | | |
|---|---|---|
| EP | 0972706 A1 | 1/2000 |

(Continued)

*Primary Examiner*—Paul R Durand
(74) *Attorney, Agent, or Firm*—Timothy J. Klima

(57) ABSTRACT

In a machine for making rigid hinge-lid packets, the lid of each packet is folded by a device (9) equipped with a plurality of pockets (2) occupied by respective single packets (P), each presenting a set of end folds (20) that will be bent inwards to form the lid (15), also, a belt conveyor (3) by which the pockets (2) are directed along a predetermined folding path (3*b*) between an infeed point (10) and an outfeed point (11), a pulley (4) centred on a vertical axis (X) of rotation, and a folder unit (12) mounted to the rotating pulley (4), interacting with a top part (13) of each pocket (2) in such a manner as to engage and bend the end folds (20) of the packet (P). The folding path (3*b*) coincides with a branch of the belt conveyor (3) looped around the pulley (4).

15 Claims, 6 Drawing Sheets

U.S. PATENT DOCUMENTS

| | | | | |
|---|---|---|---|---|
| 5,113,638 | A | 5/1992 | Focke | |
| 5,144,790 | A * | 9/1992 | Tisma | 53/251 |
| 5,570,563 | A | 11/1996 | Focke | |
| 5,806,279 | A * | 9/1998 | Spatafora | 53/399 |
| 5,806,289 | A * | 9/1998 | Sassi et al. | 53/575 |
| 6,195,959 | B1 * | 3/2001 | Tisma | 53/138.1 |
| 6,286,291 | B1 * | 9/2001 | Tale' et al. | 53/456 |
| 6,363,696 | B1 * | 4/2002 | Tisma | 53/574 |
| 6,381,921 | B1 * | 5/2002 | Tale' et al. | 53/234 |
| 6,962,556 | B2 * | 11/2005 | Tisma et al. | 493/184 |
| 6,968,667 | B2 * | 11/2005 | Spatafora | 53/234 |

FOREIGN PATENT DOCUMENTS

| | | |
|---|---|---|
| EP | 1321364 A1 | 6/2003 |
| EP | 1493667 A1 | 1/2005 |

* cited by examiner

DEVICE FOR FOLDING THE LIDS OF RIGID PACKETS IN MACHINES FOR MAKING SUCH PACKETS, AND A MACHINE INCORPORATING SUCH A DEVICE

This application is the National Phase of International Application PCT/IB2005/002605 filed Jul. 29, 2005 which designated the U.S. and that International Application was published under PCT Article 21(2) in English.

TECHNICAL FIELD

The present invention relates to a device for folding the lids of rigid packets in machines for making such packets, and to a machine incorporating such a device.

Preferably, though not exclusively, the invention finds application in the food industry for packaging loose items of small dimensions, typically sweets or candies, in rigid packets furnished with a hinged lid that can be opened and closed by the consumer.

BACKGROUND ART

Conventional machines of the type in question comprise a conveyor affording a plurality of pockets by which respective packets are accommodated and directed from an infeed station to an outfeed station. Each packet supplied to the conveyor via the infeed station presents a plurality of contiguous side walls extending parallel to a predominating axis of the selfsame packet, a plurality of bottom end folds that will be bent to form the bottom of the packet, and a plurality of top end folds that will be bent to form the lid of the packet. When the packet is taken up by the conveyor, all of the end folds are disposed parallel to the predominating axis, and have yet to be bent and glued in position.

The packets are carried by the conveyor along a predetermined feed path through a succession of processing stations. At a first such station, folder mechanisms operating alongside the pockets will engage the bottom end folds and bend them inwards to form a container with an open top.

The pockets and the part-formed packets then pass through a filling station occupiable by a plurality of hoppers from which a predetermined quantity of sweets or candies will be directed into each packet.

Prior art machines also comprise a plurality of folder units associated one with each of the pockets and brought into operation downstream of the filling station, bending and closing the top end folds to form a hinged lid.

Since a dedicated folder unit is utilized for each single size and style of packet, all of the units associated with the pockets must be changes whenever the size of the packet in production is changed. The number of folder units installed has a notable impact on the cost of the device and on the space occupied by the pockets.

The object of the present invention is to overcome the problems associated with the prior art by providing a device for folding the lids of rigid packets in machines for making such packets, and a machine incorporating such a device, such as will be unaffected by the drawbacks mentioned above.

In particular, the object of the invention is to set forth a device for folding the lids of rigid packets in machines for making such packets, and a machine incorporating such a device, that will be structurally simpler and more reliable than devices and machines of the prior art.

DISCLOSURE OF THE INVENTION

The stated object and others besides are realized substantially, according to the present invention, in a device for folding the lids of rigid packets in machines for making such packets, and in a machine incorporating such a device, as described and claimed hereinafter.

The invention will now be described in detail, by way of example, with the aid of the accompanying drawings, in which.

Figure 1:
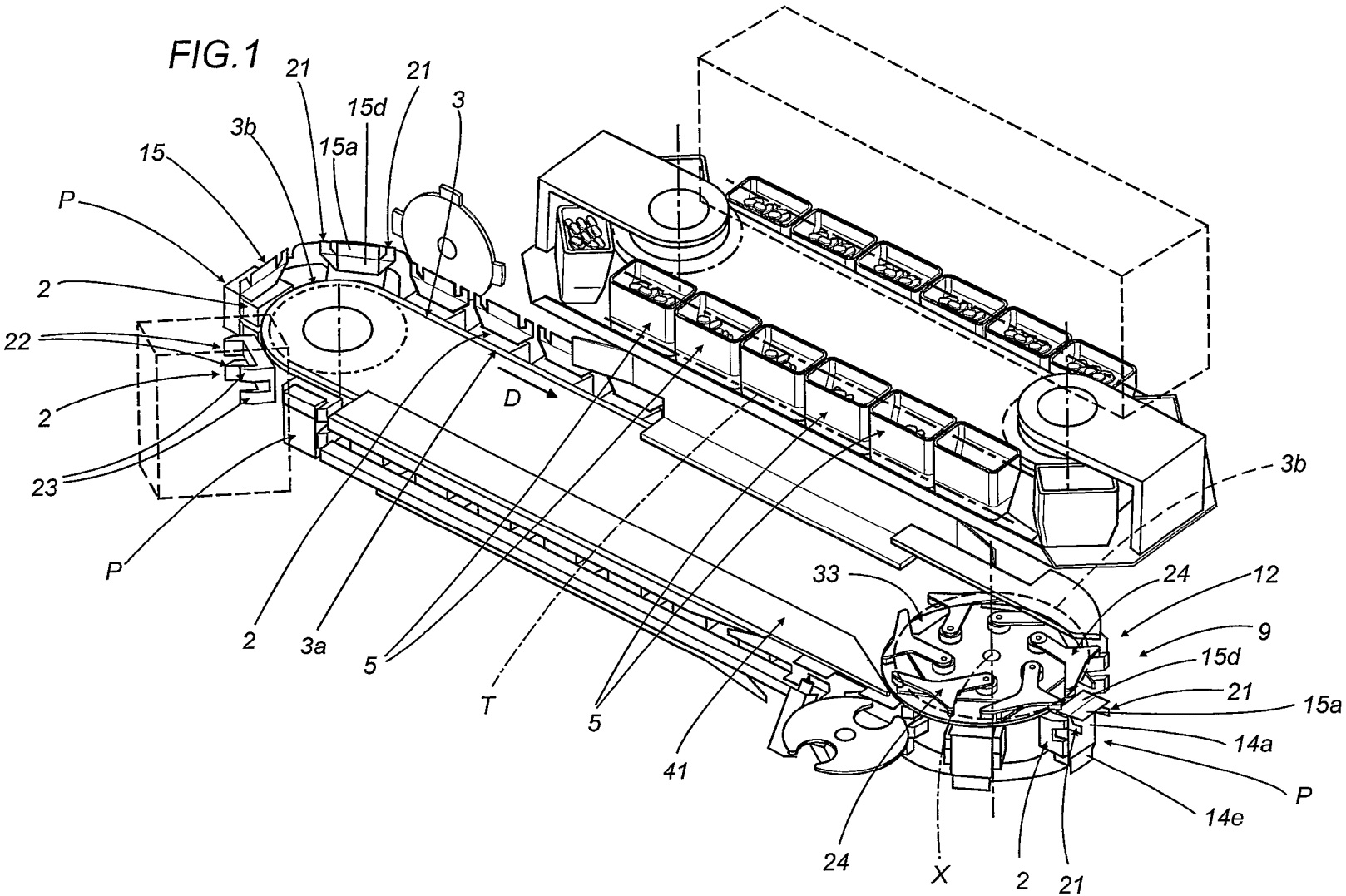
FIG. 1 is a perspective view of a machine for making rigid packets in accordance with the present invention.

Referring to the accompanying drawings, 1 denotes a machine, in its entirety, by which rigid packets are fashioned and filled with loose items of small dimensions in accordance with the present invention.

The machine 1 comprises a plurality of pockets 2 serving to accommodate respective diecut blanks shaped as packets P to be filled with items of small dimensions, such as sweets or candies. The pockets 2 are set in motion along a predetermined feed path.

In particular, the pockets 2 appear as compartments mounted to a conveyor 3 embodied preferably as a belt looped around two pulleys 4 with vertical axes of rotation, of which one only is indicated in FIGS. 1 to 7, and of which one at least is power driven. The belt conveyor 3 describes a closed loop identifying the predetermined feed path and presenting two rectilinear branches 3*a*, interconnected by two curvilinear branches 3*b* associated with the two pulleys 4.

In accordance with a conventional type of design, neither illustrated nor described in detail, flat diecut blanks are taken up from a magazine at a first processing station installed along the path followed by the conveyor 3, bent to a three-dimensional box shape, and placed each in a respective pocket 2.

Thereafter, the bottom end folds of the blank are bent at a first folding station, not illustrated, to form a packet P with an open top A.

Extending immediately downstream of the first folding station and in a direction D followed by the pockets, the feed path presents a leg T along which the packets are filled. To this end, the machine 1 presents a plurality of movable hoppers 5 alignable along the filling leg T, carried by a transport belt looped around a pair of wheels turning on vertical axes, not illustrated in the drawings.

The transport belt describes a closed loop composed of a first rectilinear branch 6, a second rectilinear branch 7 and two curvilinear branches associated with the wheels.

The hoppers 5 are loaded along the first branch 6 with sweets or candies from one or more fixed outlets of suitable feed means, not illustrated, discharging into a top opening 8 of each hopper 5.

The second rectilinear branch 7 of the loop establishes a leg along which the hoppers 5 unload, extending substantially above the predetermined leg T along which the packets P are filled. The hoppers 5 are carried above this same predetermined leg T, each with a bottom opening positioned over a corresponding pocket 2 and advancing at the same speed as the pocket. The bottom openings of the hoppers 5 are exposed and occluded by means of suitable embodiment, in such a way as to proportion the flow of sweets or candies from the hoppers 5 into the packets P along the full length of the filling leg T.

The machine 1 further comprises a folder device 9 located downstream of the filling leg T, such as will form the lid of each packet P by shaping top end folds of the relative blank that project vertically from the relative pocket 2.

In practice, the folder device 9 is identifiable as a combination of the pockets 2 holding the packets P, the pulley 4 located downstream of the filling leg T and rotating about a vertical axis X, and the part of the belt 3 extending along the curvilinear branch 3*b* looped partially around this same pulley 4. The curvilinear branch 3*b* establishes a predetermined folding path that extends between an infeed point 10 and an outfeed point 11 of the device 9, set apart by an angle of 180° approximately.

To advantage, the device 9 also includes a folder unit 12 mounted to the pulley 4, operating in close proximity to top portions 13 of the pocket 2 and in such a way as to bend the top end folds of the single packets P.

Preferably, and as in the example illustrated, each pocket 2 presents a sectional profile of U shape with the concave side directed away from the conveyor 3.

Figure 9:
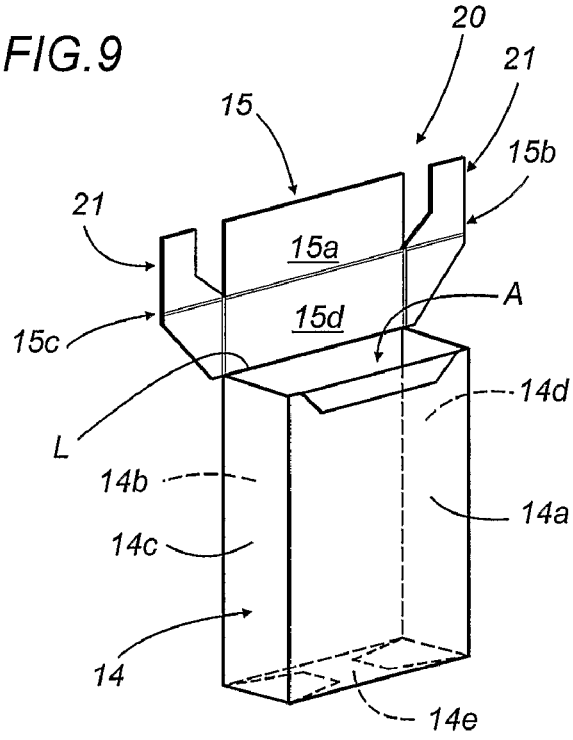
FIG. 9 shows a packet during one step of the production cycle.
Figure 10:
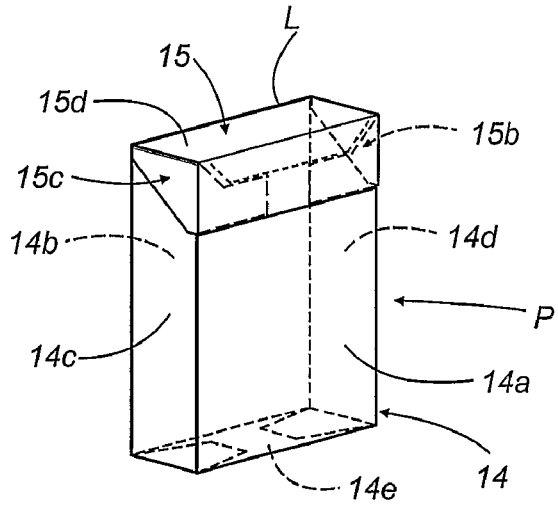
FIG. 10 shows the packet of FIG. 9 with the lid fully formed.

The pocket 2 is designed to accommodate a packet P of parallelepiped appearance (see FIGS. 9 and 10) presenting a container portion 14, comprising a front wall 14*a*, a rear wall 14*b*, two flank walls 14*c* and 14*d* and a bottom 14*e*, surmounted by a hinged lid 15. The hinged lid 15 encloses the open top A of the container portion 14 and presents a front wall 15*a*, two flank walls 15*b* and 15*c*, and a top 15*d* joined to the rear wall 14*b* of the container portion 14 along a hinge line L.

Figure 8:
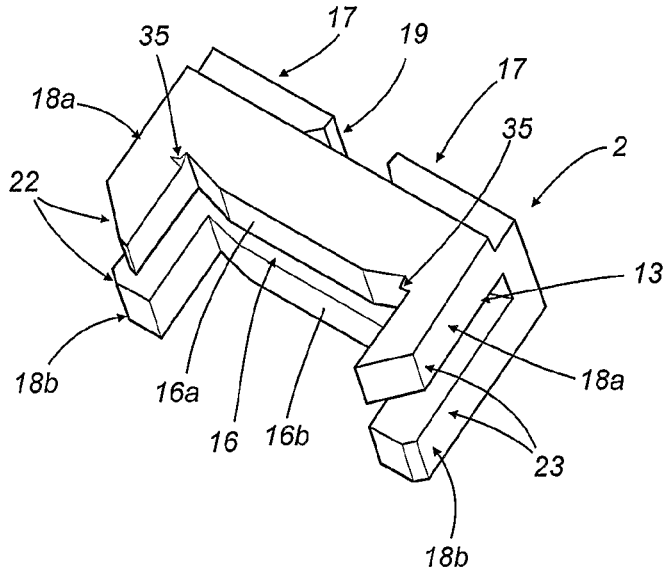
FIG. 8 is an enlarged view of an element of the machine as in FIG. 1.

As illustrated in FIG. 8, the pocket 2 presents a rear vertical wall 16 affording a surface, on the inside of the pocket 2, with which the rear wall 14*b* of the packet P is breasted in contact. More exactly, the rear vertical wall 16 comprises two horizontal portions 16*a* and 16*b*, upper and lower, set apart by two vertical connecting plates 17.

The pocket 2 also presents a pair of top lateral restraints 18*a* projecting transversely from the ends of the upper horizontal portion 16*a*, and a pair of bottom lateral restraints 18*b* projecting transversely from the ends of the lower portion 16*b*. The lateral restraints 18*a* and 18*b* coincide with the two arms of the U profile. The faces of the restraints 18*a* and 18*b* located on the inside of the pocket 2 are placed in contact with the flank walls 14*c* and 14*d* of the packet P. The rear vertical wall 16 of the pocket 2 is connected detachably to the conveyor 3 by way of a slot 19 between the two vertical plates 17, slidably accommodating a lug (not illustrated) associated rigidly with the conveyor 3.

The packet P approaches the folder device 9 with an appendage 20 of the diecut blank, destined to form the lid 15 (see FIG. 9), still projecting from the pocket 2. The appendage 20 presents a first rectangular portion joined to the rear wall 14*a* of the container portion 14 along the hinge line L of the packet P and coinciding with the top 15*d* of the lid 15, a second rectangular portion joined to the first rectangular portion 15*d* and providing the front wall 15*a* of the lid 15, two third portions of triangular outline joined to opposite ends of the first rectangular portion 15*d* and providing the flank walls 15*b* and 15*c* of the lid 15, and two flaps 21 joined each to a relative third portion 15*b* and 15*c*, which will ultimately be flattened against and secured to the second rectangular portion 15*a* (see FIGS. 9 and 10).

The packets P are retained in the pockets 2 through the agency of one or more channels (not illustrated) opening onto the inwardly directed surface of the pocket, along which to generate a suction force that will maintain the rear wall 14*b* of the packet P in contact with the rear wall 16 of the pocket 2.

Figure 2:
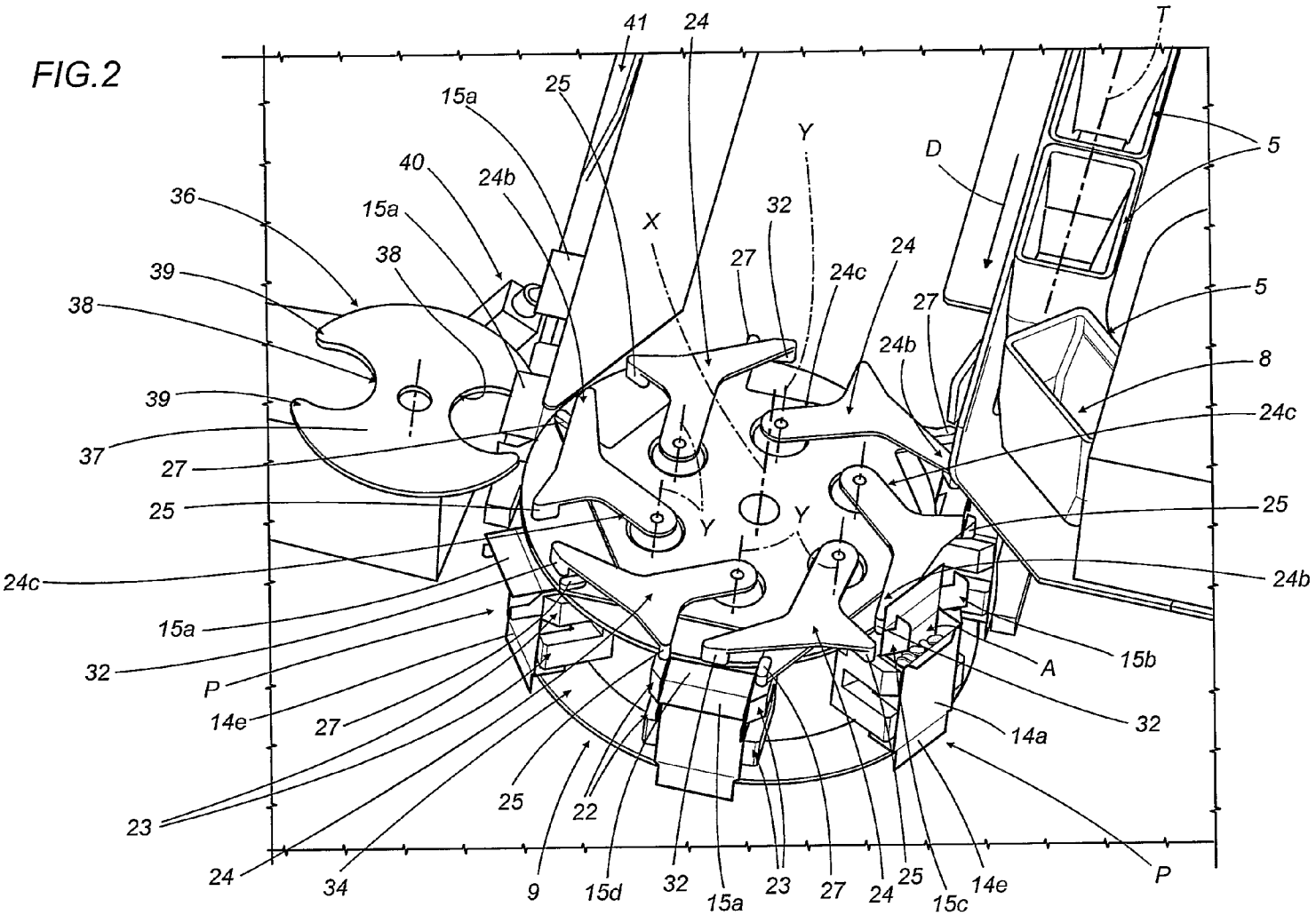
FIG. 2 illustrate a portion of the machine in FIG. 1, enlarged and in perspective.
Figure 3:
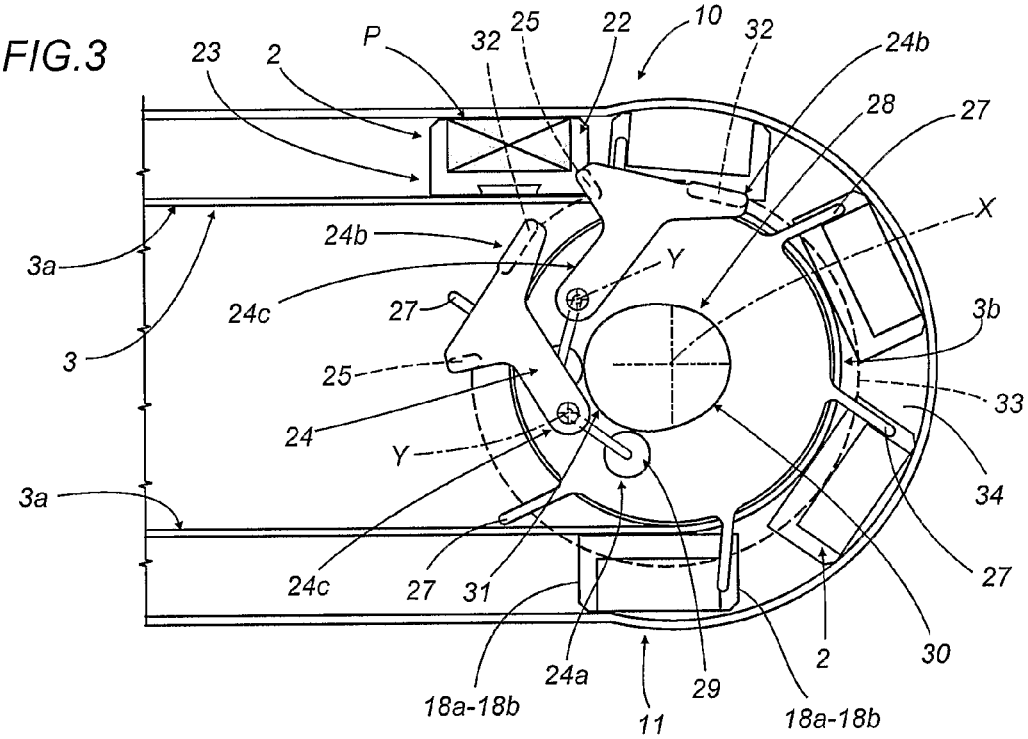
FIG. 3 shows the enlarged portion of the machine illustrated in FIG. 2, viewed in plan and in a first operating condition.
Figure 7:
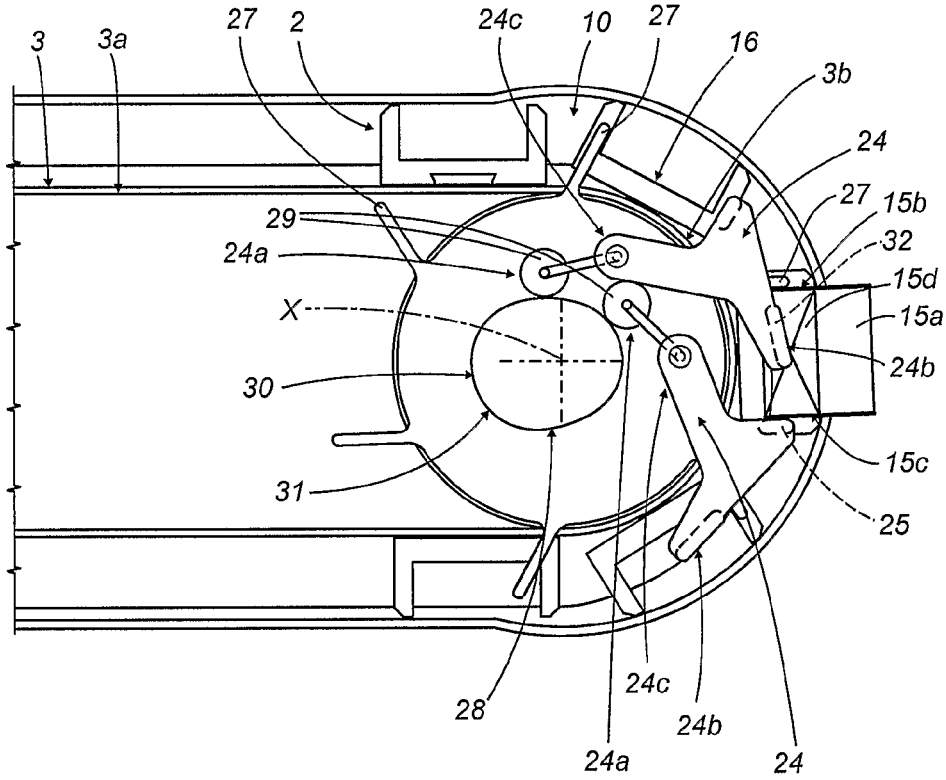
FIG. 7 shows the portion of the machine as in FIG. 3, in a fifth operating condition.

Proceeding along the predetermined folding path 3*b* in the feed direction D, each pocket 2 presents a first leading pair 22 of lateral restraints 18*a* and 18*b*, which are the first to reach the pulley 4, and a second trailing pair 23 of lateral restraints 18*a* and 18*b* which follow on thereafter (see FIGS. 2 and 7).

The folder unit 12 comprises at least one folder arm 24 anchored mechanically to the rotating pulley 4 and equipped with a pusher element 25 positioned to engage a first lateral portion of the appendage 20 presented by a packet P. In the example illustrated, this same first lateral portion of the appendage 20 consists in a corresponding third portion 15*c* of triangular outline and the associated flap 21.

Also forming part of the folder unit 12 are cam drive means 26 designed to move the folder arm 24 relative to the rotating pulley 4 between a first position and a second position during the rotation of the selfsame pulley 4.

In the first position (FIGS. 3 and 4), the pusher element 25 does not encroach on any of the pockets 2, whereas in the second position (FIGS. 5, 6 and 7) the pusher element 25 will shift alongside one of the pockets 2, adjacent to the relative top portion 13, thereby closing on the first pair 22 of lateral restraints 18*a* and 18*b* in such a way as to engage and fold the leading portion 15*c* and flap 21 of the appendage 20 presented by the packet P.

The folder unit 12 further comprises at least one finger 27, associated rigidly with the pulley 4 and projecting radially from the selfsame pulley.

Each folder arm 24 is followed by the relative finger 27 around the periphery of the pulley 4 and along a direction of rotation of the pulley 4 that coincides with the feed direction D of the pockets 2.

Figure 4:
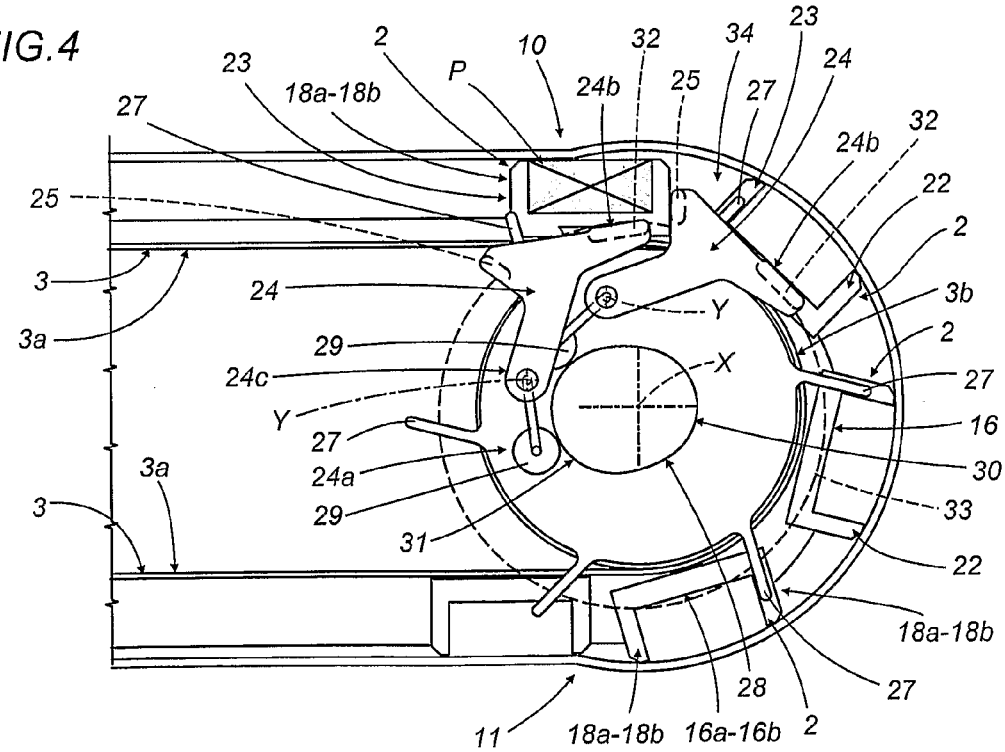
FIG. 4 shows the portion of the machine as in FIG. 3, in a second operating condition.
Figure 5:
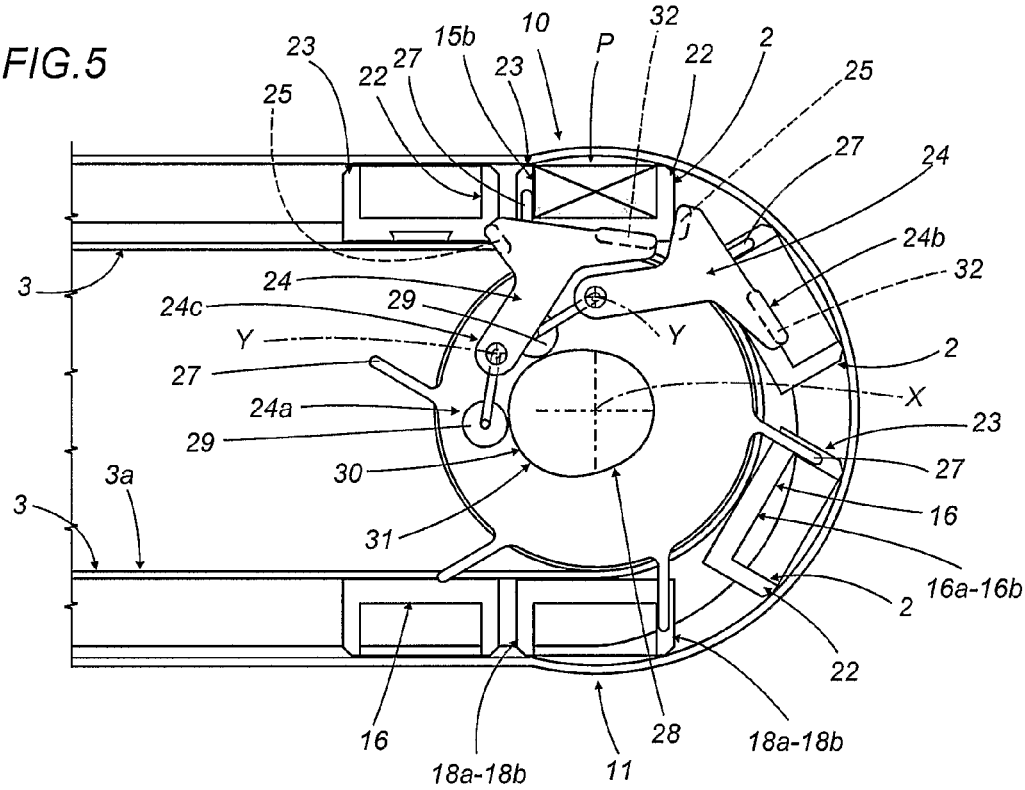
FIG. 5 shows the portion of the machine as in FIG. 3, in a third operating condition.

At the infeed point 10 of the folder device 9, the finger 27 draws alongside the pocket 2, adjacent to the top portion 13 and on the side opposite from the pusher element 25 of the folder arm 24, in such a way as to engage and fold the trailing portion 15*b* and flap 21 of the appendage 20 presented by the packet P occupying the pocket 2 (FIGS. 4 and 5).

In the course of the movement, the finger 27 closes on the second pair 23 of lateral restraints 18*a* and 18*b*.

At this stage, the first and second rectangular portions 15*d* and 15*a* of the appendage 20 are still disposed parallel to the rear wall 14*b* of the container portion 14 whilst the two triangular third portions providing the flank walls 15*b* and 15*c* of the lid 15, and the two relative flaps 21, now extend at right angles to the first and second rectangular portions 15*d* and 15*a* (FIG. 2).

Preferably, and as illustrated in FIGS. 1 and 2, the folder device 9 will present a plurality of folder arms 24, and a corresponding plurality of fingers rigidly associated with the pulley 24. Each folder arm 24 occupies a position substantially overlying the finger 27 associated with the preceding folder arm 24, considered relative to the feed direction D, or to the rotation of the pulley 4. In the interests of clarity, only two folder arms 24 are shown in FIGS. 3 to 7.

More exactly, each folder arm 24 presents a first end 24*a* linked to the cam drive means 26, a second end 24*b* located opposite to the first end 24*a* and carrying the pusher element 25, and an intermediate portion 24*c* anchored pivotably to the pulley 4 by way of a relative fulcrum axis Y parallel to the axis X of rotation of the pulley 4.

The fulcrum axes Y of the folder arms 24 are arranged around the rotational axis X of the pulley 4 on a virtual circumference concentric with this same axis X.

The cam drive means 26 comprise a fixed disc cam 28 mounted to coincide with the rotational axis X of the pulley 4, and a cam follower 29, preferably a roller, carried by the first end 24*a* of the folder arm 24 and riding in contact with the fixed cam 28.

The fixed cam 28 presents a profile 30 to the cam follower 29 that extends around the axis X of rotation of the pulley 4 and is shaped in such a manner as to impose a law of motion on the arm 24, during the rotation of the pulley 4, that will avoid unwarranted interference with the pockets 2 and with the packet P while folding the appendage 20 of each successive packet P as described above.

In the example of FIGS. 3 to 7, the cam 28 presents a profile 30 of ovoid geometry. Moreover, the radial distance separating the profile 30 from the axis X of rotation is greater at a portion 31 of the cam 28 positioned farthest from the curvilinear branch 3*b*, relative to the axis X of rotation. To advantage, each of the folder arms 24 will also present an auxiliary pusher element 32 directed away from the second end 24*b* and from the fulcrum axis Y of the arm 24, positioned to coincide with one vertex of a triangle having as its other two vertices the second end 24*b* of the arm and the fulcrum axis Y (FIGS. 3 to 7).

Figure 6:
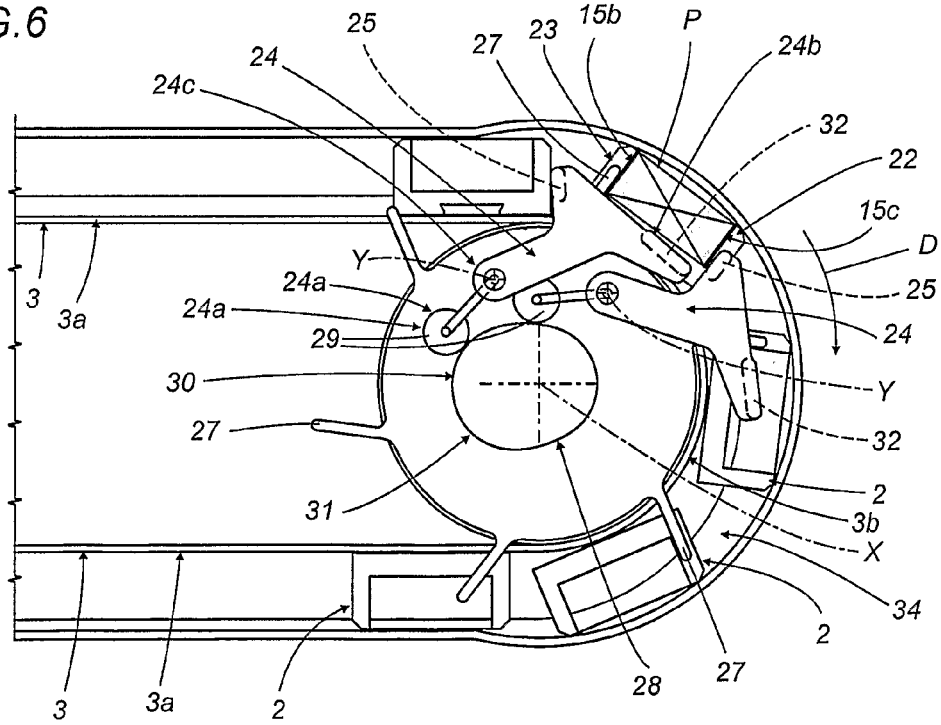
FIG. 6 shows the portion of the machine as in FIG. 3, in a fourth operating condition.

As discernible from FIG. 6, when the pusher element 25 of one of the folder arms 24 occupies the second position, relative to one of the pockets 2, the auxiliary pusher element 32 of this same arm 24 will swing over the pocket 2 preceding in sequence along the feed direction D, so that a rear portion presented by the appendage 20 of the packet P occupying the pocket 2 in question is bent over the open top A of the selfsame packet P. In effect, the rear portion of the appendage 20 consists in the first and second rectangular portions 15*d* and 15*a* of the appendage 20.

As an alternative or an addition to the auxiliary pusher element 32, the device 9 presents a fixed guide 33 extending along the predetermined folding path 3*b*, above the pockets 2. Measured radially from the axis X of rotation, the guide 33 increases in width from the infeed point 10 toward the outfeed point 11 of the device 9 (FIGS. 2 to 7), so as to superpose each advancing packet 2 progressively and bend the rear portion of the appendage 20 downwards, likewise progressively.

Used on its own, the fixed guide 33 performs the same function as the auxiliary pusher element 32.

Preferably, and as illustrated in FIG. 2, the fixed guide 33 is employed in conjunction with the auxiliary pusher element 32 and enters into contact with the packet P after the auxiliary element 32 has already begun to bend the rear portion of the appendage 20 over the open top A of the packet P. The function of the auxiliary pusher element 32 is to bring about the first stage of the folding step, accompanying the rear portion of the appendage 20 so as to as to reduce the angle of incidence at which the rear portion of the appendage 20 enters into contact with the fixed guide 33.

To counterbalance the action of the auxiliary pusher element 32 and/or the fixed guide 33, the folder device 9 also presents a surface 34 on which the bottom 14*e* of each packet P is positioned. The surface 34 in question is fixed, extending beneath the pockets 2 along the predetermined folding path 3*b* and embodied as an annular or circular plate concentric with the axis X of rotation (see FIGS. 1 and 2).

The packet P entering the outfeed point 11, that is to say immediately downstream of the area covered by the pulley 4, arrives with the second rectangular portion, destined to provide the front wall 15*a* of the lid 15, projecting at right angles from the front wall 14*a* of the container portion 14. Also, the two third portions of triangular outline providing the flank walls 15*b* and 15*c* of the lid 15 are placed alongside the flank walls 14*c* and 14*d* of the container portion 14 with the two flaps 21 projecting at right angles from the front wall 14*a* of the container portion 14 (FIG. 2).

During the step of folding the first rectangular portion 15*d* and the second rectangular portion 15*a* of the appendage 20, the two third portions 15*b* and 15*c* of triangular outline are inserted between the flank walls 14*c* and 14*d* of the container portion 14 and the lateral restraints 18*a* and 18*b* of the pocket 2, and accordingly, the inwardly directed faces of the top restraints 18*a* present respective stepped portions 35 shaped to accommodate the third portions 15*b* and 15*c*.

In particular, as illustrated in FIG. 8, the stepped portion 35 on each of the top lateral restraints 18*a* of the pocket 2 is angled downwardly and away from the rear wall 16 and has the effect of increasing the clearance between the top lateral restraints 18*a* and a top part of the pocket 2, so as to admit the third portions 15*b* and 15*c* of the folded lid 15.

Finally, the folder device 9 comprises an auxiliary folder assembly 36 stationed at the outfeed point 11, serving to complete the formation of the lid 15 (FIGS. 1 and 2).

The auxiliary folder assembly 36 presents a disc 37 rotatable about a vertical axis, affording at least one recess 38 (two are shown in the drawings) such as will create a pair of tips 39 designed to interact with the flaps 21 of the advancing packet P. The flaps 21 are flattened by the auxiliary folder assembly 36 against the front wall 14*a* of the container portion 14. Thereafter, an applicator 40 installed beyond the disc 37 will deposit a layer of adhesive on the underside of the second rectangular portion 15*a*. Finally, this same second rectangular portion 15*a* is flattened against the flaps 21 by a fixed restraint 41 to secure the join.

The problems associated with the prior art are thus overcome by the present invention, and the stated objects duly realized.

First and foremost, a device according to the invention for folding the lid of a rigid packet affords a simplified structure of the pocket in which the packet is accommodated, achieving more compact dimensions and reducing the number of parts making up the machine as a whole. In effect, given that folder units are no longer installed on each individual pocket, the number of folder units mounted to the pulley can be less than the number of pockets carried by the conveyor.

Accordingly, the device disclosed is instrumental in reducing production costs and expenditure on maintenance of the machine, rendering the machine itself more reliable, and simplifying the operations of changing from one size of packet to another.

The invention claimed is:

1. A device for folding the lids of rigid packets in machines for making such packets, comprising a plurality of pockets accommodating respective packets each presenting an upwardly projecting appendage foldable to form a relative lid, and a conveyor by which the pockets are fed along a predetermined folding path between an infeed point and an outfeed point of the folder device, wherein it comprises a pulley, centered on a relative axis of rotation, around which the conveyor is looped partially in order to establish the predetermined folding path, and a folder unit, mounted to the rotating pulley and operating in close proximity to top portions of the pockets in such a way as to bend the upwardly projecting appendages of the packets, and wherein the folder unit comprises at least one folder arm anchored mechanically to the rotating pulley and equipped with a pusher element positioned to engage a first lateral portion of the appendage presented by a packet, and cam drive means by which the folder arm is moved relative to the rotating pulley between a first position and a second position during the rotation of the pulley.

2. A device as in claim 1, wherein the cam drive means shift the folder arm between the first position, in which the pusher element does not encroach on the pockets, and the second position in which the pusher element is brought alongside one of the pockets, adjacent to the relative top portion, so as to engage and fold the first lateral portion of the appendage presented by the packet occupying the pocket.

3. A device as in claim 2, wherein the folder unit further comprises at least one finger, associated rigidly with the pulley and projecting radially from the pulley, which can be brought alongside the pocket, adjacent to the top portion and on the side opposite from the pusher element of the folder arm, so as to engage and fold a second lateral portion of the appendage presented by the packet occupying the pocket.

4. A device as in claim 3, wherein the folder arm is followed by the relative finger around the periphery of the pulley along a direction of rotation described by the pulley.

5. A machine as in claim 2, wherein each folder arm also includes an auxiliary pusher element directed away from the pusher element in such a way that when the pusher element of the folder arm occupies the second position, relative to one of the pockets, the auxiliary pusher element of the arm is positionable over the pocket preceding in sequence along the direction followed by the pockets, causing a rear portion presented by the appendage of the packet occupying the pocket to be bent over an open top of the packet.

6. A device as in claim 2, wherein the folder arm presents a first end linked to the cam drive means, a second end located opposite to the first end and carrying the pusher element, and an intermediate portion anchored pivotably to the pulley by a relative fulcrum axis.

7. A device as in claim 6, wherein the cam drive means comprise a fixed disc cam mounted to coincide with the axis of rotation of the pulley, and a cam follower mounted to the first end of the folder arm.

8. A device as in claim 6, comprising a plurality of folder arms, each linked by way of the respective first end to the cam drive means, and a plurality of fingers associated rigidly with the pulley.

9. A device as in claim 8, wherein the fulcrum axes of the folder arms are arranged around the axis of rotation of the pulley.

10. A device as in claim 1, further comprising a fixed guide extending along the predetermined folding path, above the pockets, by which a rear portion of the appendage presented by a packet is bent over an open top of the selfsame packet.

11. A device as in claim 1, comprising an auxiliary folder assembly stationed at the outfeed point and serving to complete the formation of the lid.

12. A device as in claim 1, wherein each pocket includes a sectional profile of U shape disposed with a concave side directed away from the conveyor.

13. A device as in claim 12, wherein packets passing along the predetermined folding path are caused to stand on a fixed surface extending beneath the pockets and along the folding path.

14. A device as in claim 12, wherein the mutually opposed internal faces of the U-profile pocket each include a stepped portion matched in shape to the lid of the packet.

15. A machine for making packets, comprising a folder device as in claim 1.

* * * * *